United States Patent [19]

Ediger et al.

[11] Patent Number: 4,896,795

[45] Date of Patent: Jan. 30, 1990

[54] GRAIN MOISTURE SENSOR

[76] Inventors: Randall J. Ediger, 132 N. 3rd St., Hampton, Nebr. 68843; Richard Boelts, 320 Elk Creek Rd., Malcolm, Nebr. 68402

[21] Appl. No.: 144,187

[22] Filed: Jan. 15, 1988

[51] Int. Cl.[4] ..... F26B 13/12

[52] U.S. Cl. ..... 222/63; 222/52; 324/664; 34/56

[58] Field of Search ..... 34/56; 324/61 P; 222/56, 63, 77, 23, 25

[56] References Cited

U.S. PATENT DOCUMENTS

| | | | |
|---|---|---|---|
| 2,654,864 | 7/1949 | Tuck . | |
| 3,141,129 | 7/1964 | Dietert . | |
| 3,149,650 | 9/1964 | Horst | 222/52 |
| 3,714,718 | 2/1973 | Sukup | 34/56 |
| 3,760,267 | 9/1973 | Williams | 324/61 |
| 3,761,810 | 9/1973 | Fathauer | 324/61 |
| 4,168,466 | 9/1979 | Boldt | 324/61 |
| 4,259,632 | 3/1981 | Ahtiainen | 324/61 |
| 4,288,742 | 9/1981 | Walsh | 324/61 |
| 4,499,111 | 2/1985 | Oetiker | 426/231 |
| 4,599,809 | 7/1986 | Parkes | 34/31 |
| 4,750,273 | 6/1988 | Parkes et al. | 34/56 |

*Primary Examiner*—H. Grant Skaggs
*Attorney, Agent, or Firm*—John A. Beehner

[57] ABSTRACT

A grain moisture sensor includes a capacitor having at least a pair of capacitor plates positioned within a grain drying bin adjacent the bottom wall and in spaced relation from the peripheral side walls so that grain in the bin fills the space between the plates and passes downwardly between the plates in response to operation of the discharge auger for the bin. The sensor further includes electrical circuitry for measuring the capacitance of the capacitor, calculating the percentage moisture content of the grain and controlling the activation of the discharge auger for removing a uniform layer of grain from the bottom of the bin in response to the percentage moisture content being lowered to a selected amount.

18 Claims, 8 Drawing Sheets

GRAIN MOISTURE SENSOR

BACKGROUND OF THE INVENTION

The present invention is directed generally to an electronic grain moisture sensor for use in a grain-drying bin for measuring the percentage moisture content of grain at a position within the bin and for activating a discharge auger to remove a generally uniform layer of grain from the bottom of the bin when the measured percentage moisture content is lowered to a selected value.

The earliest electronic grain moisture testors were operated by direct current conductance. This method is accurate if moisture content is consistent throughout the kernel but rapid drying causes the outside of the kernel to be drier than the center thereby providing inaccurate results.

There are also several known ways to measure grain moisture content by oven drying. The fastest of these methods, however, requires three hours and a grinding of the grain which are unacceptable for an on-line control system.

The Karl Fischer titration method is a chemical test which is specific for water. This is probably the most accurate moisture measurement method but it would likewise not be practical for an on-line control system.

Microwave attenuation, while very accurate, is unsuitable because it is based on the dielectric loss factor which is not as consistent or well defined as the dielectric constant. Accordingly, expensive research would be required for development.

Most electronic equipment used for measurement of moisture in grain is based on capacitance measurement. The capacitance of a given sensor depends on the dielectric constant of the grain in the sensor. Since the dielectric constant for grain is much lower than the dielectric constant for water, a small amount of change in the amount of moisture in grain causes a relatively large change in its dielectric constant. This change in dielectric constant with grain moisture content makes it ideal for use in controlling drying equipment.

Most known grain moisture sensing devices require a sample of grain to be taken from the bin to an external testing unit or auger. This involves additional apparatus and expense and can introduce inaccuracies due to the limited quantity of the sample being tested. Finally, another problem with known grain dryer control systems is the need for frequent adjustment to accommodate for changes in ambient temperature and fan temperature and the inaccuracies which are introduced when such frequent adjustments are not attended to.

Accordingly, an object of the present invention is to provide an improved grain moisture sensor.

Another object is to provide such a sensor for accurately determining moisture content of grain for controlling the discharge of grain from a drying bin.

Another object is to provide an improved grain moisture sensor wherein moisture content is measured at a position within the bin adjacent the bottom wall therein so as to eliminate the need for removing a sample of grain to be tested externally of the bin.

Another object is to provide a grain moisture sensor of sufficient accuracy to minimize overdrying of grain.

Another object is to provide a grain moisture sensor which is simple and rugged in construction, inexpensive to manufacture, install and operate and which is efficient in operation.

SUMMARY OF THE INVENTION

The grain moisture sensor of the present invention includes a capacitor having at least a pair of capacitor plates mounted on a support frame and adapted to be positioned within a grain drying bin adjacent the bottom wall thereof and in spaced relation from the peripheral side wall thereof. The capacitor plates are supported on the frame in uniformly spaced apart substantially vertical relation so that grain in the bin fills the space between the plates and passes downwardly between the plates in response to operation of the discharge auger around the bottom wall of the bin. The sensor further includes an electrical circuit including means for appying an electrical potential across the capacitor, means for measuring the capacitance of the capacitor and control logic electrically connected to the measuring means and operative to calculate the percentage moisture content of grain between the capacitor plates as a function of the capacitance of the capacitor. The control logic is electrically connected to the discharge auger for activating the auger to remove a generally uniform layer of grain from the bottom of the bin in response to the percentage moisture content being lowered to a selected amount.

The capacitance measuring means may include an oscillator elecrically connected to the capacitor so as to produce an output frequency indicative of the capacitance thereof and a counter operative to measure the output frequency of the oscillator and to communicate said frequency to the control logic. The electrical circuit may further include a temperature sensor, amplitude and phase detectors, means for measuring the test weight of grain in the bin, all for communicating information to the control logic for accurately adjusting the calculation of percentage moisture content of the grain.

The grain moisture sensor of the invention is designed to save farmers time and money while drying corn.

The sensor is mounted inside the drying bin and works by testing the moisture of corn ready to be put into a storage bin. Testing moisture of corn instead of just the temperature can be advantageous for a number of reasons.

The grain moisture sensor can assure farmers that their corn will be dried only to the point that it should be dried. This prevents the overdrying of corn which happens with temperature sensing systems. When corn is overdried, the farmer loses money three ways.

First, drying corn is expensive. Three gallons of LP gas are used to dry one acre of corn, approximately 130 bushels, one point. Accordingly, if one acre of corn is dried from 15.5% moisture to 14.5% moisture, it takes three gallons of LP gas or approximately $1.05 an acre, approximately $.08 per bushel. The electricity cost can also be as much as $.65 an acre or $.05 a bushel. If a farmer would dry 40,000 bushels to 14.5% moisture instead of 15.5% he could lose over $500.00.

Secondly, corn shrinks when it is over dried. Corn that is dried from 15.5% loses at least one percent of its weight, being reduced from 56 pounds to 55.4 pounds per bushel. This could be a loss of $3.00 per acre. Thirdly, corn also loses quality when it is over dried.

Finally, the grain moisture sensor will assure the farmer that his corn will be dry enough when it leaves the drying bin. This will prevent spoilage in the storage bin. Because farmers lose many bushels each year to spoilage, it can be even more serious than overdrying With the government storage programs, keeping corn from spoiling is more important than ever.

The biggest advantage of the grain moisture sensor of the invention may be the time that it will save each farmer during the busy weeks of harvest. After the grain moisture sensor is installed, the farmer simply needs to set it for the moisture at which he wants the corn to leave his drying bin. The sensor takes over from there and starts the withdraw system only at that moisture. The grain moisture sensor removes the worry of overdrying and underlying and quickly pays for inself by saving both time and money.

DESCRIPTION OF THE PREFERRED EMBODIMENT

Figure 2:
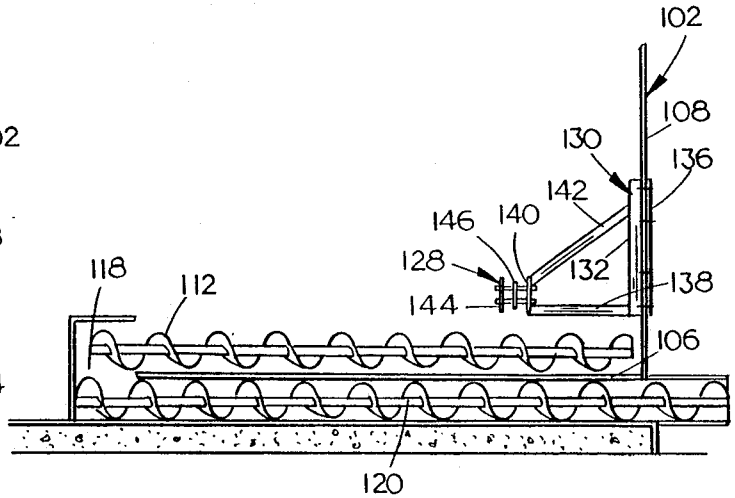
FIG. 2 is an enlarged partial shortened sectional view of the grain drying bin and a grain moisture sensor.
Figure 1:
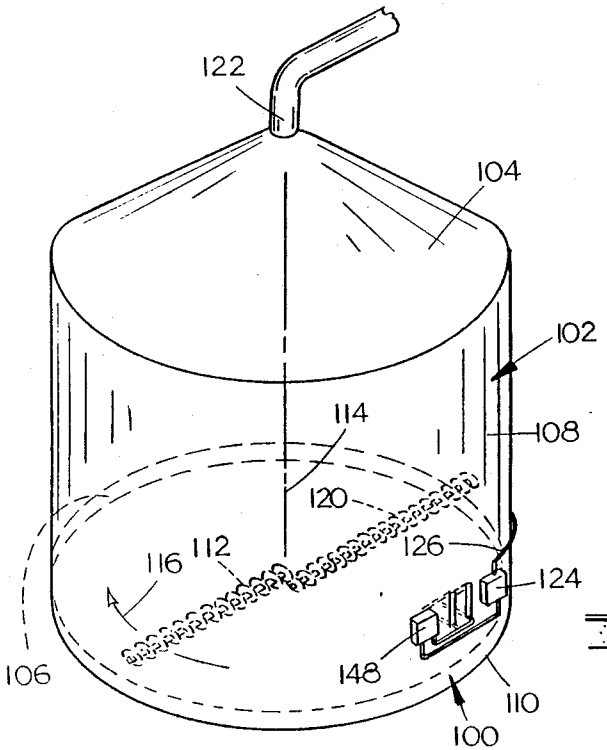
FIG. 1 is a diagrammatic perspective view of a grain drying bin equipped with the grain moisture sensor of the invention.

The grain moisture sensor 100 of the present invention is illustrated in FIGS. 1 and 2 as installed on a grain drying bin 102 having a top wall 104, bottom wall 106, and a peripheral side wall 108 which contains and supports grain within the bin. Bottom wall 106 is spaced above foundation 110 and supports a rotating discharge auger 112 which revolves about a central vertical axis 114 to remove a generally uniform layer of grain from the bottom of the bin. The discharge auger 112 is rotated in the direction of arrow 116 and conveys grain centrally of the bottom wall for passage through a central opening 118 for removal of grain from the bin through a stationary secondary auger 120. Generally, bottom wall 106 is perforated and a blower and/or heater are provided for forcing dry air upwardly through the grain in the bin for drying the same. Electrical controls for discharge auger 112 and secondary discharge auger 120 may be provided in an auger control box 124 mounted on the exterior surface of side wall 108 for connection to the auger by electrical line 126. High moisture grain to be dried is entered into the bin through an input chute 122 at the peak of top wall 104.

Figure 3:
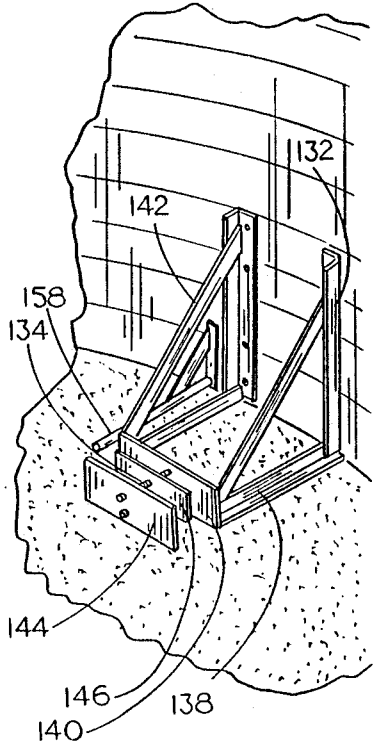
FIG. 3 is a perspective view of the capacitor and support frame therefor.

Referring to FIGS. 2 and 3, the grain moisture sensor 100 includes a capacitor 128 supported by a frame 130 within the bin 102 adjacent bottom wall 106 and in spaced relation from side wall 108. Frame 130 is illustrated as including a pair of upright posts 132, each secured on the interior surface of side wall 108 in upright vertical relation by several bolts 134 extended through the respective posts, side wall and retaining strip 136 and secured by suitable nuts or the like. A support arm 138 extends into the bin from the base of each post 132 for securement to an exterior capacitor plate 140. A diagonal gusset 142 extends upwardly from the plate 140 to an upper portion of post 132 for securely supporting the capacitor 128 within the bin. A pair of bolts extend inwardly from capacitor plate 140 for supporting an interior capacitor plate 144 and a central capacitor plate 146. Exterior and interior plates 140 and 144 are electrically connected to ground, wherein central capacitor plate 146 is electrically insulated from bolts 134 and the other capacitor plates by an insulator collar or the like so that an electrical potential may be applied across the spaces between central plate 146 and exterior and interior plates 140 and 144. For this purpose, an electrical conduit may be extended along one support arm 138 with wires extended therethrough for electrical connection to the capacitor plates.

Note that the capacitor plates are supported on frame 130 in uniformly spaced apart substantially vertical relation whereby grain 148 in the bin 102 fills the spaces between the capacitor plates and passes downwardly between the capacitor plates in response to operation of the discharge auger 112.

The capacitance method for moisture testing of grain works by measuring the electrical characteristic known as permittivity. The permittivity is made up of the dielectric constant and the dielectric loss factor. Recent work by the USDA (Nelson 1984) has established an accurate equation that can be used to determine the moisture content of grain from measurement of its dielectric constant. This equation requires knowledge of the signal frequency used for measurement, temperature and test weight of the grain.

Permittivity is determined by counting the frequency of the test signal. Signal frequency is known because it is part of the test used to determine permittivity. Temperature can be easily and inexpensively measured. The test weight can either be measured electronically or by measuring the pressure of the grain in the bin at two different heights.

The grain moisture tester would be based on the following equation for grain moisture content;

$$M = \frac{\sqrt[3]{\frac{E'r - .012(T - 24) - 1}{\rho}} - .466 + .077\log(f)}{.034 - .0023\log(f)}$$

where m is moisture content in percent f is frequency in megahertz

Figure 4:
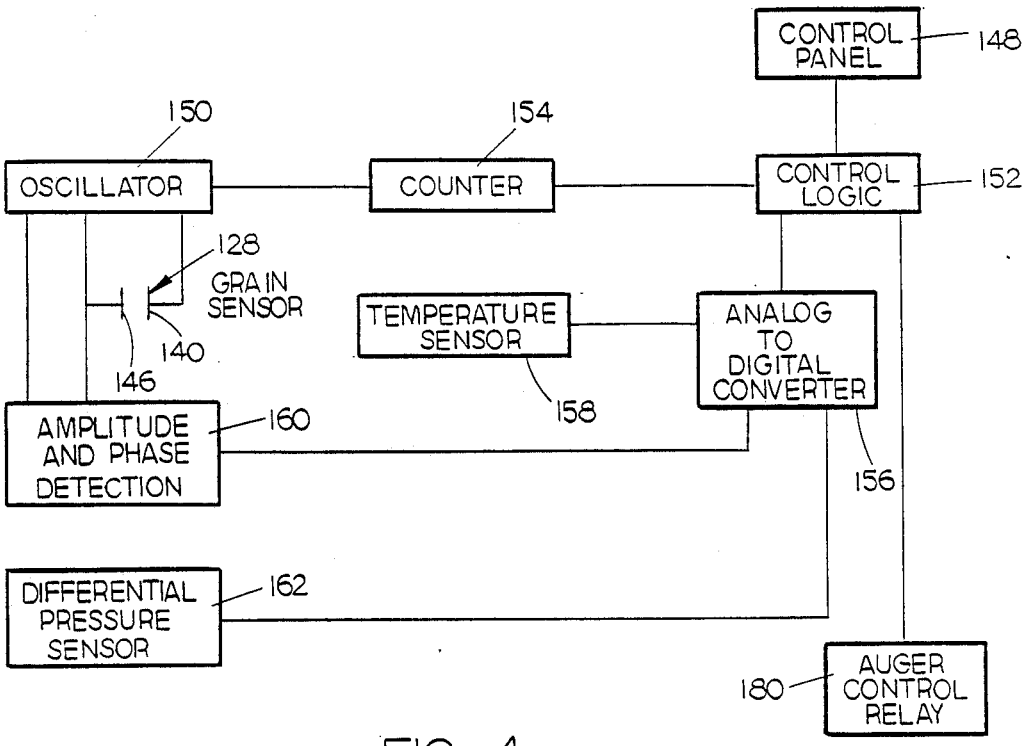
FIG. 4 is a block diagram of the electrical circuit for the grain moisture sensor.

E'r is the dielectric constant as determined by the frequency is the bulk density or test weight in g/cm T is the temperature in degrees centrigrade FIG. 4 is a block diagram of the proposed grain moisture sensor of the invention. The control panel 148 is used to set the desired grain moisture content. The oscillator 150 is first used to generate a frequency to determine the capacitance of the sensor. That capacitance determination is used by the control logic 152 to calculate the dielectric constant of the grain between the capacitor plates.

The counter 154 is used to find the frequency of the oscillator 150. The analog to digital converter 156 converts voltage signals from the temperature sensor 158, amplitude sensor 160, phase sensor 160 and differential pressure sensor 162 to a signal to control logic 152 can use. A conventional temperature sensor 158 is mounted interiorly of the bin adjacent capacitor 128 for providing the temperature information used by the control logic 152 to compensate for changes in grain temperature. Amplitude and phase detection provide the control logic information which can be used to find the dielectric constant and the dielectric loss factor. These parameters can also be used to find the test weight in accordance with a favored method developed by Kraszewski in 1977, or, in the alternative, the differential pressure sensor 162 could provide the test weight measurement. Because the test weight figures into the calculations in a rather insubstantial amount, it is not a critical input and the system is operable without it.

It is apparent that the heart of the grain dryer controller of the invention is the capacitor 128 mounted in the grain 148 which is being dried. The capacitor uses the grain as a dielectric so changes in grain moisture change its capacitance. The capacitor is part of RC oscillator 150 so changes in capacitance cause a change in the oscillator's output frequency. The counter 154 counts cycles of the oscillator for a given time. The control logic of computer 152 then takes this count and uses it with temperature information from sensor 158 to determine the moisture of the grain. If the grain is above a preset moisture, it is allowed to dry longer. If it is below the preset moisture, the discharge auger 112 is activated to remove the uniform layer of grain from the bottom of the bin.

Manual operation of the control panel 148 will first be described followed by a description of the circuitry which operates the invention as described.

Figure 5:
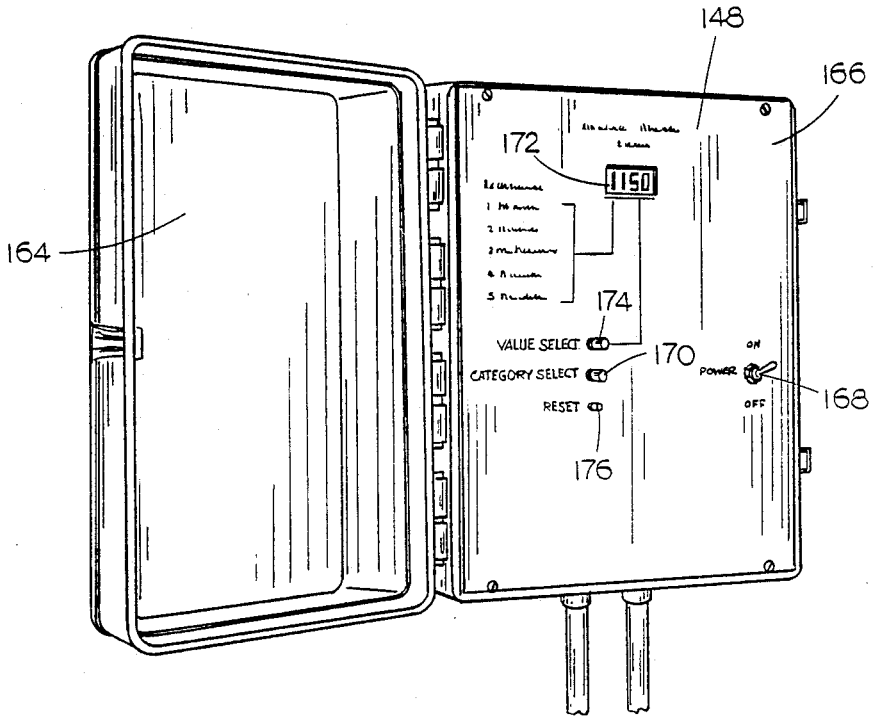
FIG. 5 is a front elevational view of the control panel for the invention.

Referring to FIG. 5, control panel 148 has a transparent hinged cover plate 164 which may be opened to expose the front panel 166. The operator's first step is to turn the power switch 168 to the "on" position. Next, the Category Select button 170 is pushed until the number 1 appears in the left position of the LCD readout 172. This puts the system in the moisture mode.

Next, the value select button 174 is pressed until the last three numbers in the LCD readout 172 show the value for moisture content to which the corn is to be dried. The last number in this sequence is tenths of a percent so 155, for example, indicates a moisture content of 15.5%.

The programmed moisture content will display for two seconds after the which the actual calibrated value of the moisture content of the corn will display for four seconds. This allows the operator to see the difference between the discharge moisture and the actual moisture of the grain in the bin.

The actual calibrated value of the moisture is input to the system by pushing the category select button 170 until the number two appears in the left position of the LCD readout 172. This puts the system in the calibrate mode. The value select button 174 is then depressed until the last three numbers in the LCD readout correspond to the value for the actual moisture content of the corn as measured independently from the grain moisture sensor of the invention. The reset button 176 is then pressed.

For operation in the alternate temperature mode, the category select button 170 is pressed until the number 3 appears in the left position of the LCD readout 172. The value select button 174 is then pressed until the last three numbers in the LCD readout 172 show the value of the temperature at which the operator wants to discharge the grain. The reset button 176 is then pushed.

The programmed temperature value will display for two seconds, after which the actual temperature of grain in the bin, as sensed by temperature sensor 158, will display for four seconds. This allows the operator to see the difference between the actual temperature of the grain in the bin and the discharge temperature he has selected.

When switching from the temperature mode to the moisture mode, there is a one and half minute delay between when the operator programs the values and when it switches to the other mode. During this time, the left digit of the LCD readout 172 will change from 1 to 3 and the operator can get both moisture and temperature readings.

To set timing delays for the discharge auger 12, the operator pushes the category select button 170 until the number 4 appears in the left position of the LCD readout 172. This puts the system in the Delay On mode. The value select button 174 is then pressed until the last three numbers in the LCD readout 172 show the number of seconds between when the sensor 100 determines that the auger 112 should start (according to the programmed moisture and temperature values) and when the auger actually starts. The reset button 176 is then pushed.

Next, the category select button 170 is again pressed until the number 5 appears in the left position of the LCD readout. This puts the system in the Delay Off mode. The value select button is pressed until the last three numbers in the LCD readout 172 show the number of seconds between when the sensor 100 determines that the auger 112 should stop (according to the programmed moisture and temperature values) and when the auger actually stops. Again, the reset button 176 is pushed to complete all necessary manual inputs for initiating operation of the system.

The electrical circuitry for effecting the above-described operation is illustrated in FIGS. 6 through 10. Referring first to the electrical circuit for the control panel illustrated in FIG. 6, it is seen that the category select button 170, value select button 174 and reset button 176 are all connected to a master board 178 which also has the capacitor 128 and temperature sensor 158 connected to it as additional inputs. The output at W15 is directed to motor control 180 which controls the actuation and deactuation of the discharge auger 112.

Figure 7:
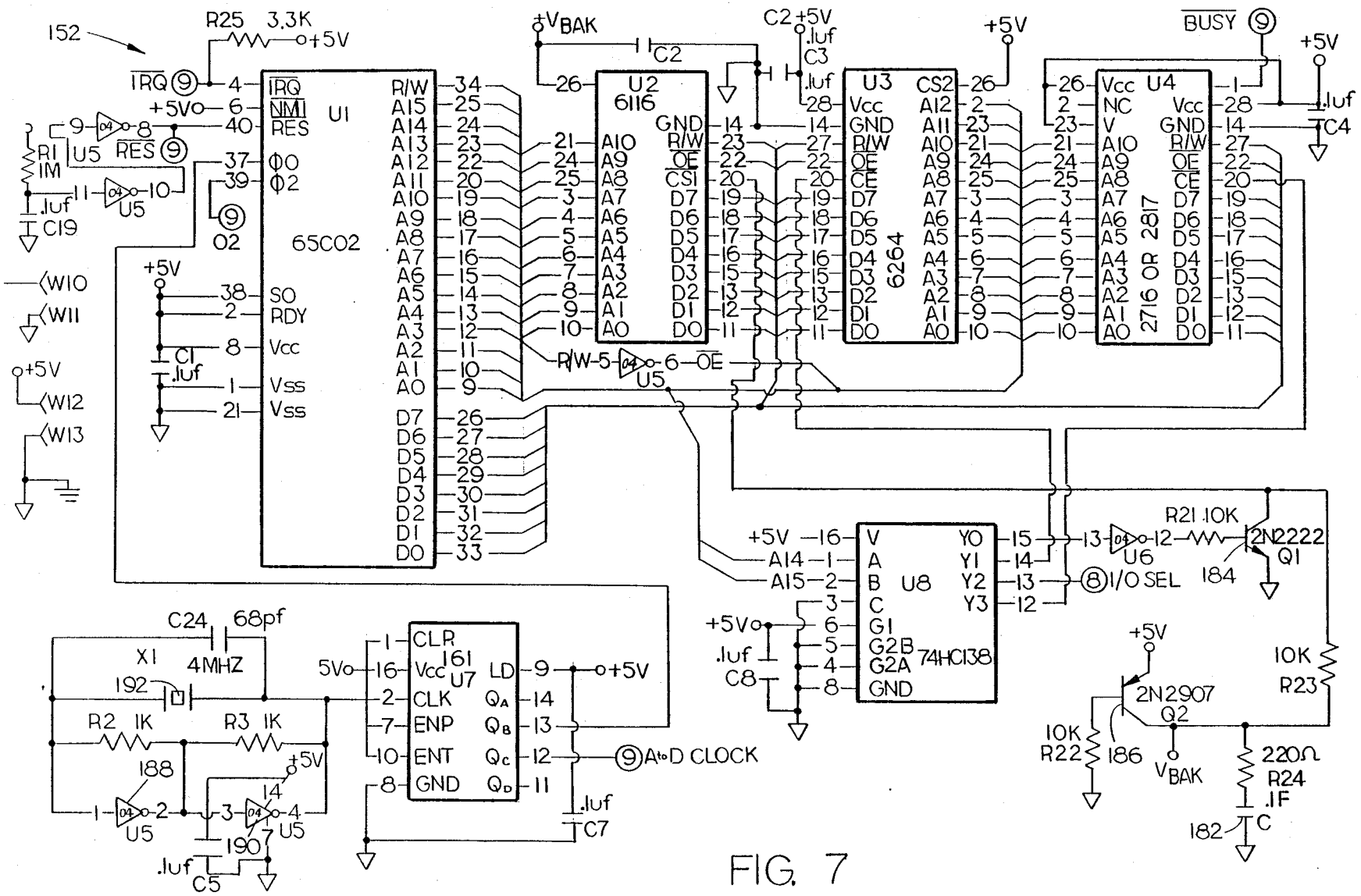
FIG. 7–10 are composite portions of a detailed electrical circuit diagram of the invention.

FIG. 7 illustrates the microprocessor which is responsible for basic control of the overall circuitry. All logical decisions such as whether the discharge auger 112 is to be turned on or off are made by this circuitry. The decision making is actually done by the U1 chip which is designated 65CO2. The program or sequence of events that is to be followed is in U4 which is a 2716 chip that is a ROM so the software is loaded into that chip and then the microprocessor U1 follows those instructions to provide all control functions. U2 is a RAM for temporary storage of information. The U2 stores the results of any math that is performed, timing sequences, delays for the auger and the like. U3 is likewise a RAM chip labelled 6264 so as to have 8K bits of RAM as opposed to the 2K bits of RAM in the U2. The U8 is a 74HC138 chip which decodes addresses from the microprocessor U1 and determines which chip is being accessed at any given point in time. Thus it will enable whatever chip is to be addressed by the microprocessor.

The circuitry in the lower right corner of FIG. 7 includes a capacitor 182 which serves to store current so that if the power is turned off, that current comes back out and goes to U2 to provide a voltage backup that will maintain the information that is stored in U2. Accordingly, when the power is turned back on the next day or after a power failure, all information stored in the U2 remains in tact. The transistors 184 and 186 are associated with capacitor 182 for turning it on and off and charging it up.

The circuitry in the lower left corner of FIG. 7 includes two inverters 188 and 190 that are used as an oscillator in association with a crystal 192. That oscillator provides the 4 megahertz signal that is set over to U7, which is a 74HC161 chip, that is a counter that divides the 4 megahertz down into 1 megahertz. The 1 megahertz signal is sent over to the microprocessor U1 as the clock signal required for the microprocessor to run. Thus the system clock for microprocessor U1 comes off of pin 13 of U7. Also, another clock signal at only 500 kilohertz is taken off pin 12 for the analog to digital converter U16 in FIG. 9. The encircled 9 A to D CLOCK designation at pin 12 of U7 designates a connection to the A to D CLOCK shown in FIG. 9.

Figure 8:
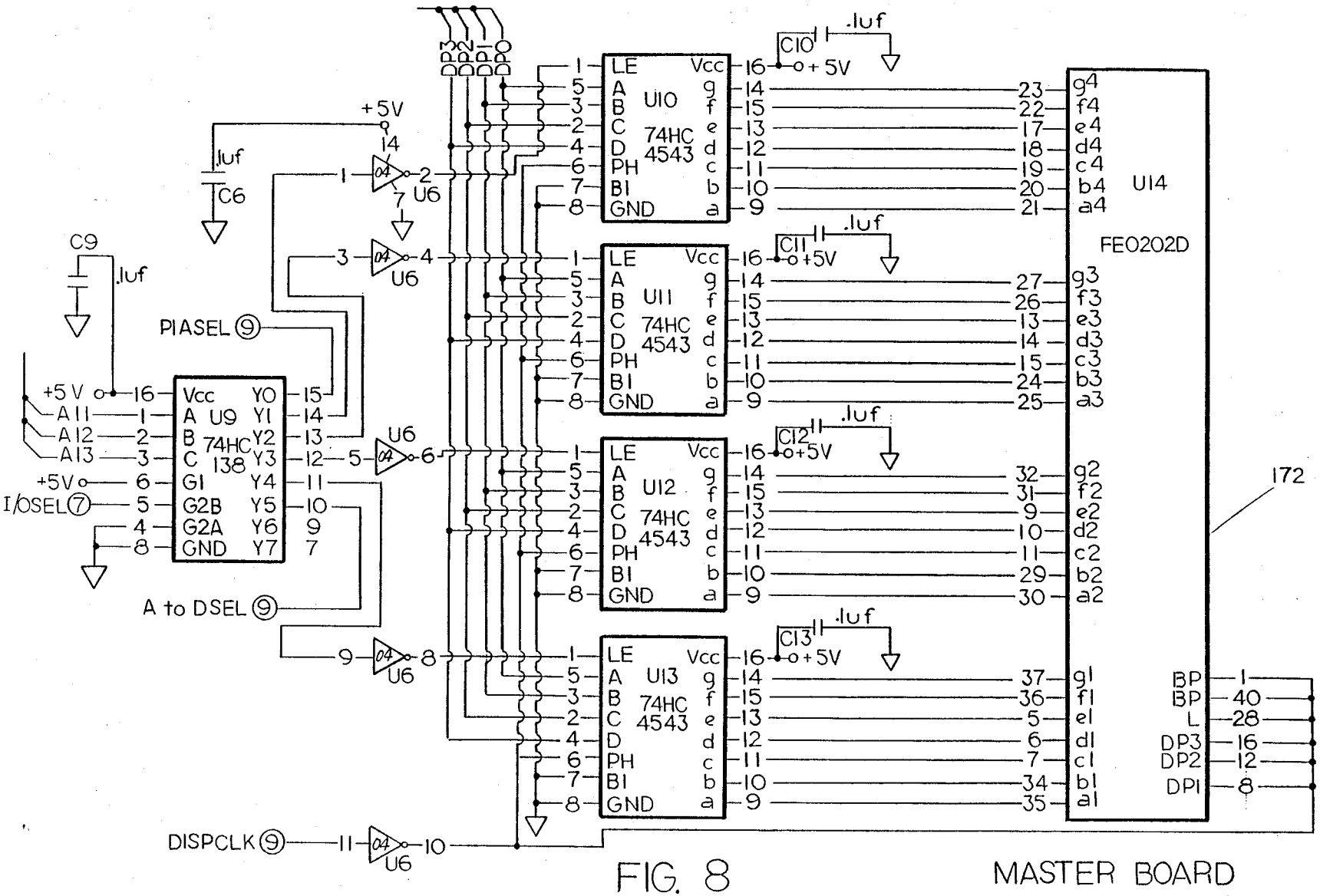

Referring now to FIG. 8, the U9 chip, designated 74HC138 is an address decoder. The connection at pin 5 labelled I/O SEL is connected to pin 13 of U8 in FIG. 7. Both the U8 and U9 decode microprocessor address information. That information is used to enable memory or peripheral chips when the microprocessor needs to access them. U8 in FIG. 7 breaks the microprocessor address space up into 7 pieces and 3 of them are dedicated to memory which are those labelled U2 through U4 in FIG. 7. The other one U9 is dedicated to input and output and that is what takes the block of memory and divides it up again eight times. The eight output signals from U9 all run off to the chips U10 through U13 of the liquid crystal display 172. If the microprocessor wants to output information for the operator, it clocks that information to the four chips U10 through U13 which are 74HC4543's. They will accept a number from 0 to 9 on the left side inputs A, B, C and D and the information goes out on a, b, c, d, e, f and g. Thus U10 through U13 are display driver chips. U14 is the liquid crystal display having four digits. If the microprocessor clocks a number into one of the driver chips U10 through U13, that number is displayed on the associated display.

Figure 6:
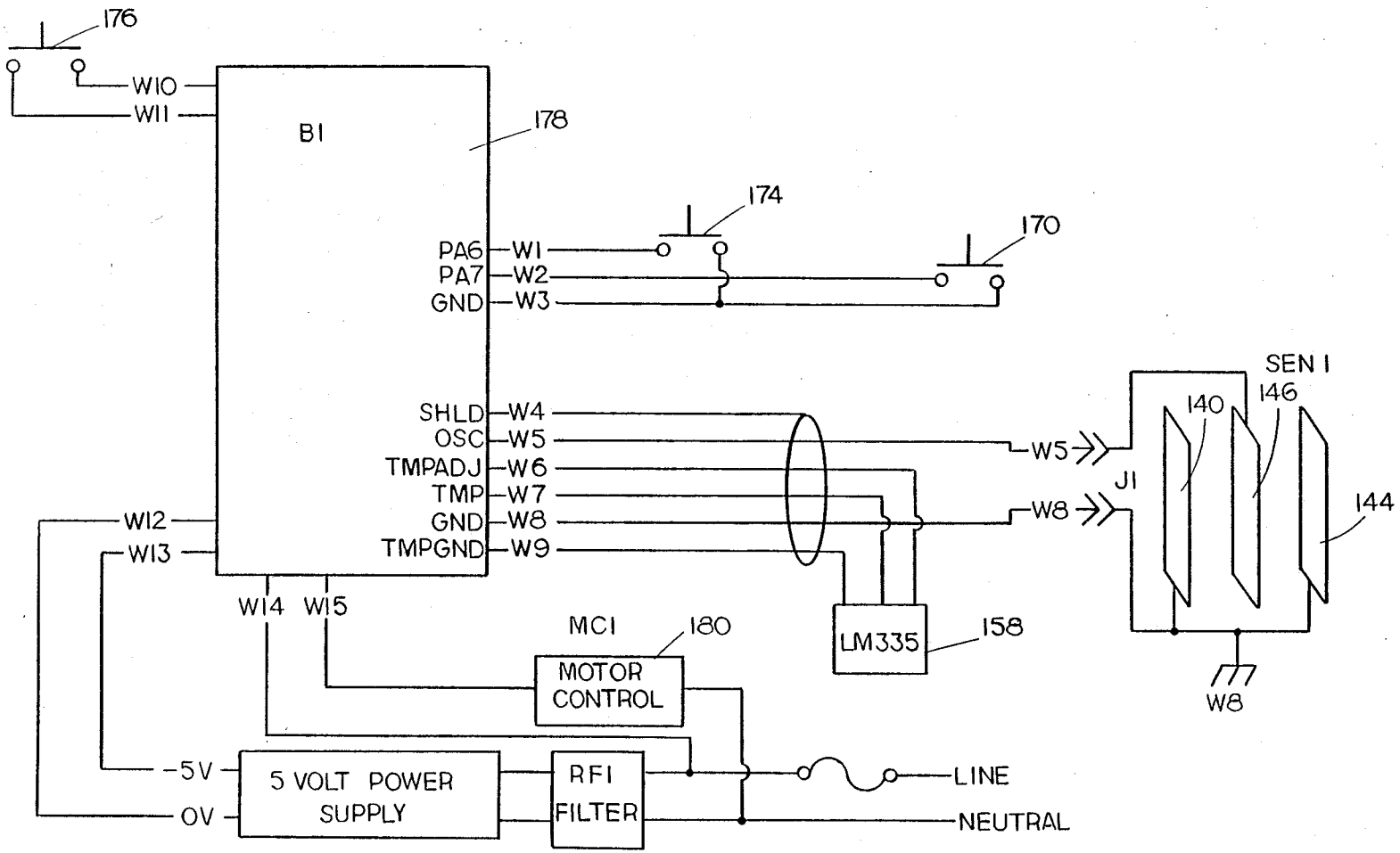
FIG. 6 is an electric circuit diagram for the control panel.
Figure 9:
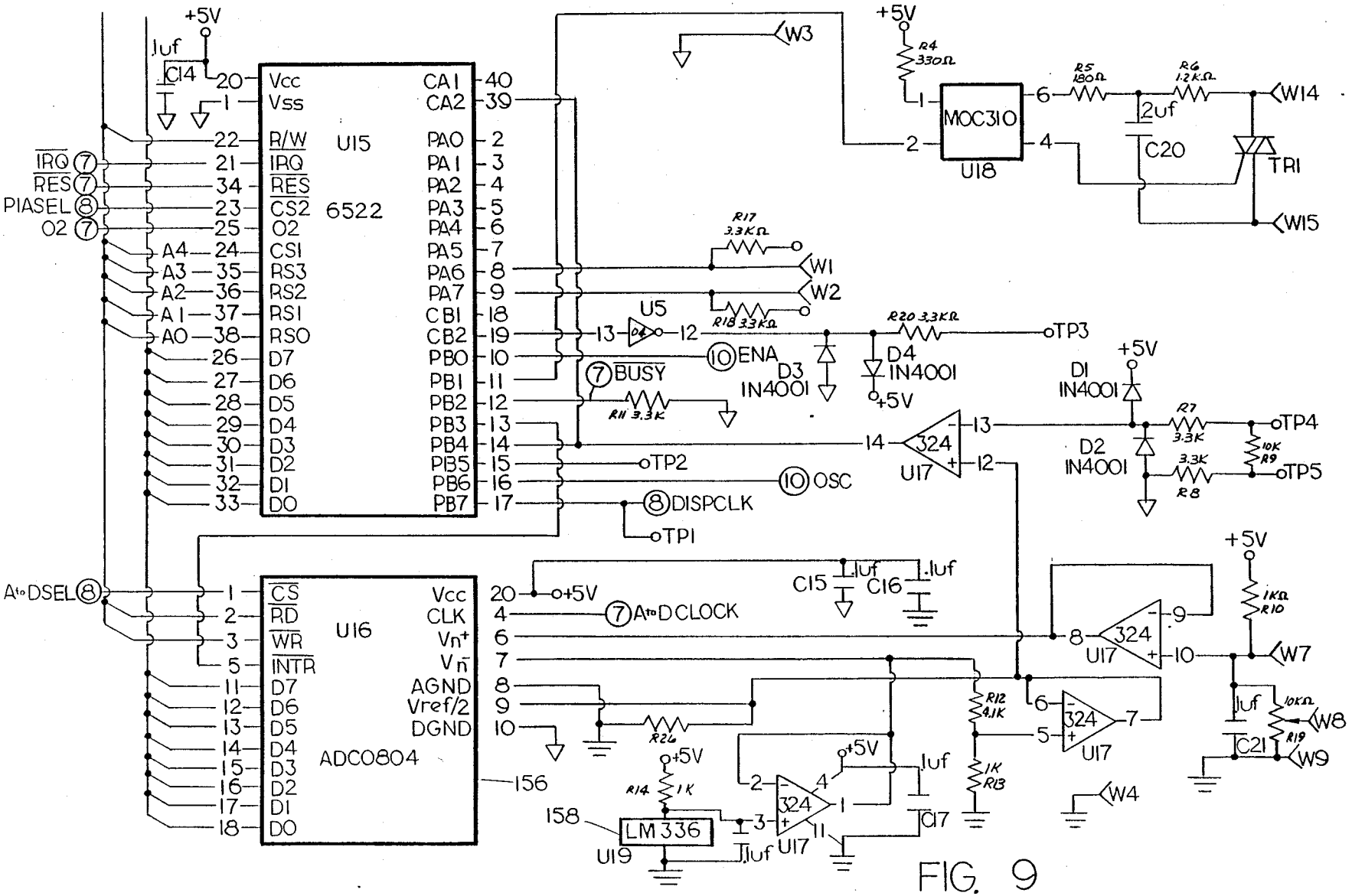

The rest of the input and output is illustrated in FIG. 9. There are two main chips here that are very important. The first one is U15, a versitile interface adapter designated 6522. It has two eight bit parallel ports. There is a timer and a counter in this chip. The lines coming in at pins 8 and 9 are connected to the value select button 174 and category select button 170 as indicated in FIG. 6 so this is where the operator inputs information.

The reference generated from the LM336, which is a 2.5 volt zener diode, provides special temperature compensation. The main reason for that is to provide the reference voltage. U6 is the analog to digital converter 156 which is used to convert the temperature information from temperature sensor 158 (LM336) into a digital number for use by the microprocessor. Since the value of capacitance from the grain sensor 128 varies with temperature, the information provided by the temperature sensor 158 is needed together with the capacitance information to determine what the moisture content of the grain is.

Figure 10:
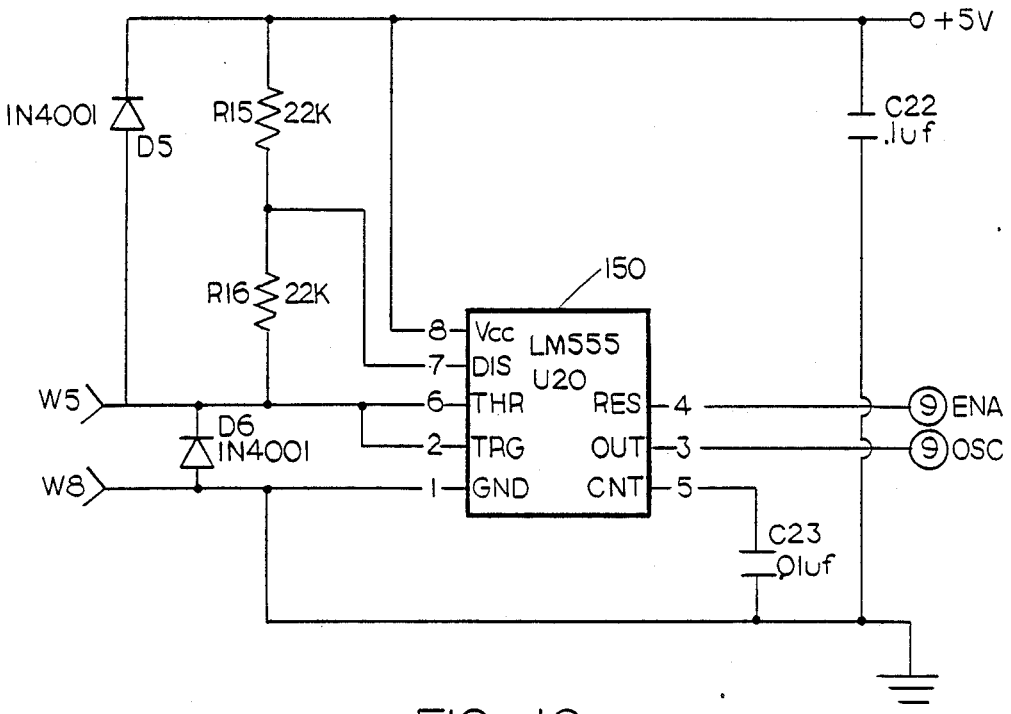

Referring to FIG. 10, the U20 is an LM555 chip, the oscillator 150, which provides a frequency that is proportional to the capacitance of the grain. U20 is used in the astable mode. Resistors R15 and R16 and the capacitor 128 which ties in at W5 and W8, as illustrated in FIG. 6, determine the frequency output of the oscillator 150 (U20).

Figure 11:
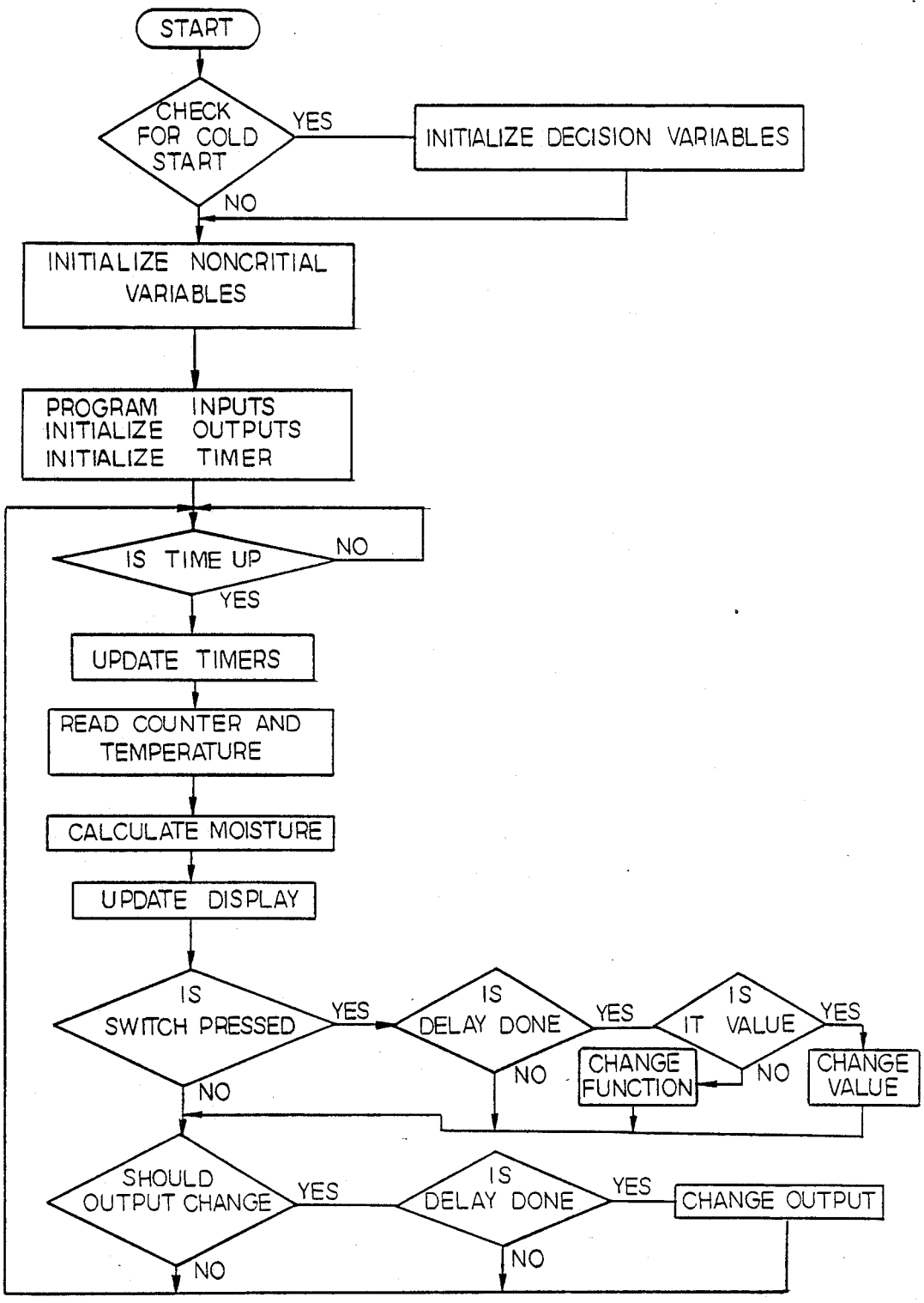
FIG. 11 is a flow chart for the software or program that is stored.

FIG. 11 is a flow chart for the software or program that is stored in U4 in FIG. 7 directing the operation of the microprocessor U1. The actual calculation of moisture content is based substantially on the equation described above and it is apparent that various different programs can be devised for utilizing that general equation to provide the moisture content determinations.

Whereas the invention has been shown in connection with a preferred embodiment thereof, it is understood that many modifications, substitutions and additions may be made which are within the intended broad scope of the appended claims. For example, whereas the capacitor plates 140, 142 and 144 are shown as flat plates, they could alternately be concentric cylinders vertically disposed so as to offer minimum resistance to grain passing downwardly between them. The flat plates, however, are less expensive and easier to manufacture.

The size of the plates are preferably selected so that the quantity of grain in between the plates and affecting capacitance amounts to approximately two and one half gallons of grain. That relatively large volume is advantageous for accuracy since whatever little variance occurs in the number of kernels has an insignificant effect.

The in-the-bin mounting of the capacitor 128 eliminates the need for removing a sample of grain from the bin for testing. Applicant's sensor provides a simple reliable structure for accomplishing the difficult function of measuring moving corn. Operation of the present invention is not affected by ambient temperature or fan temperature so no adjustments need be made for these factors. The sensor is operative to drive the discharge auger 112 through a single revolution at a time thereby to remove a single layer of grain of substantially uniform thickness from the bottom of the bin each time that the auger is activated.

Grain moisture 100 of the invention is situated directly within the grain above the auger preferably about six inches off the bottom wall 106 and spaced at least that distance inwardly from peripheral sidewall 108.

The invention is equally applicable for use in large commercial grain dryers wherein the grain is passed downwardly between perforated concentric walls. The sensor would simply be mounted within the grain between the walls.

Thus there has been shown and described a grain moisture sensor which accomplishes at least all of the stated objects.

We claim:

1. A grain moisture sensor for measuring the moisture content of grain within a grain dryer bin adjacent the bottom wall thereof, which dryer includes a peripheral wall for containing and supporting grain within the bin, means for input of relatively high moisture grain into the top of the dryer and discharge means operative to remove a generally uniform layer of grain from the bottom of the dryer, said grain moisture sensor comprising, at least one capacitor including at least a pair of capacitor plates, a support means, said capacitor plates being supported on said support means such that, upon mounting of said support means on the dryer, said capacitor plates are positioned within the dryer adjacent to bottom wall and in spaced relation from the peripheral wall, said capacitor plates being supported in uniformly spaced apart substantially vertical relation whereby, upon mounting of said support means in said dryer, grain in the dryer fills the space between the plates and passes downwardly between the plates in response to operation of the discharge means, and an electrical circuit including measuring means for measuring the capacitance of said capacitor, control logic means electrically connected to said measuring means and operative to calculate the percentage moisture content of grain between said capacitor plates as a function of the capacitance of said capacitor, and means for electrically connecting said control logic means to said discharge means for activating said discharge means to remove a layer of grain from the bottom of the bin in response to the percentage moisture content of grain between said capacitor plates being lowered to a selected amount.

2. The grain moisture sensor of claim 1 wherein said capacitor plates are substantially flat.

3. The grain moisture sensor of claim 1 wherein said measuring means includes an oscillator electrically connected to said capacitor so as to produce an output frequency indicative of the capacitance of said capacitor, and a counter operative to measure the output frequency of said oscillator and to communicate said frequency to said control logic means.

4. The grain moisture sensor of claim 3 wherein said electrical circuit further includes a temperature sensor operative to measure the temperature of grain adjacent said capacitor, means for communicating said temperature to said control logic means and said control logic means being operative to adjust said percentage moisture content calculation to compensate for changes in temperature.

5. The grain moisture sensor of claim 4 wherein said electrical circuit further includes amplitude and phase detectors electrically connected between said oscillator and said control logic means thereby to provide said control logic means with information for determining the dielectric constant and dielectric loss factor.

6. The grain moisture sensor of claim 4 wherein said electrical circuit further includes means for measuring the test weight of grain in the dryer and means for communicating said test weight measurement to said control logic means.

7. The grain moisture sensor of claim 6 wherein said means for measuring test weight comprises a differential pressure sensor adapted to be mounted in said dryer.

8. In combination, a grain dryer including a top wall, bottom wall and peripheral side wall for containing and supporting grain within the dryer, and discharge means operative to remove a generally uniform layer of grain from the bottom of the dryer, and a grain moisture sensor, comprising a capacitor including at least a pair of capacitor plates, a support means mounted on said dryer; said capacitor plates being supported on said support means at a position within the dryer adjacent the bottom wall and in spaced relation from the peripheral wall; said capacitor plates being supported in uniformly spaced apart substantially vertical relation whereby grain in the dryer fills the space between the plates and passes downwardly between the plates in response to operation of the discharge means; an electrical circuit including measuring means for measuring the capacitance of said capacitor, control logic means electrically connected to said measuring means and operative to calculate the percentage moisture content of grain between said capacitor plates as a function of the capacitance of said capacitor, and means electrically connecting said control logic means and said discharge means such that said discharge means is activated to remove a layer of grain from the bottom of the dryer in response to said percentage moisture content being lowered to a selected amount.

9. The combination of claim 8 wherein said capacitor plates are substantially flat.

10. The combination of claim 8 wherein said measuring means includes an oscillator electrically connected to said capacitor so as to produce an output frequency indicative of the capacitance of said capacitor, and a counter operative to measure the output frequency of said oscillator and to communicate said frequency to said control logic means.

11. The combination of claim 10 wherein said electrical circuit further includes a temperature sensor operative to measure the temperature of grain adjacent said capacitor, means for communicating said temperature to said control logic means, and said control logic means being operative to adjust said percentage moisture content calculation to compensate for changes in temperature.

12. The combination of claim 11 wherein said electrical circuit further includes amplitude and phase detectors electrically connected between said oscillator and control logic means thereby to provide said control logic means with information for determining the dielectric constant and dielectric loss factor.

13. The combination of claim 11 wherein said electrical circuit further includes means for measuring the test weight of grain in the dryer and means for communicating said test weight measurement to said control logic means.

14. The combination of claim 13 wherein said means for measuring test weight comprises a differential pressure sensor in said dryer.

15. The combination of claim 11 further comprising a control panel mounted exteriorly of said dryer and electrically connected to said control logic means, said control panel including means for communicating to said control logic means percentage moisture content information for grain to be input at the top of the dryer.

16. The combination of claim 15 wherein said control panel further includes means for displaying the percentage moisture content information calculated by said control logic means.

17. The combination of claim 8 wherein said discharge means comprises an auger movably supported on said bottom wall for revolution about the center of said bottom wall.

18. The combination of claim 8 wherein said support frame is mounted on an interior surface of said peripheral side wall and extends interiorly therefrom.

* * * * *